US012753000B2

(12) United States Patent
Cajas Joaqui

(10) Patent No.: US 12,753,000 B2
(45) Date of Patent: Oct. 6, 2026

(54) DISPENSER FOR SHEET MATERIALS

(71) Applicant: Kimberly-Clark Worldwide, Inc., Neenah, WI (US)

(72) Inventor: Maria del Mar Cajas Joaqui, Puerto Tejada (CO)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 48 days.

(21) Appl. No.: 18/848,759

(22) PCT Filed: Apr. 28, 2022

(86) PCT No.: PCT/US2022/026726
§ 371 (c)(1),
(2) Date: Sep. 19, 2024

(87) PCT Pub. No.: WO2023/211449
PCT Pub. Date: Nov. 2, 2023

(65) Prior Publication Data
US 2025/0206516 A1 Jun. 26, 2025

(51) Int. Cl.
*B65D 83/08* (2006.01)
*A47K 10/42* (2006.01)
*B65D 5/02* (2006.01)

(52) U.S. Cl.
CPC ..... *B65D 83/0805* (2013.01); *A47K 10/42* (2013.01); *B65D 5/0227* (2013.01)

(58) Field of Classification Search
CPC ..... B65D 5/0227; B65D 5/06; B65D 5/4204; B65D 5/70; B65D 83/0805; B65D 83/0894; B65D 83/08; A47K 10/20; A47K 10/42
(Continued)

(56) References Cited

U.S. PATENT DOCUMENTS 3,036,729 A * 5/1962 Asman ..... B65D 5/16 221/48
3,083,866 A * 4/1963 Strange ..... B65D 5/16 221/302

(Continued)

FOREIGN PATENT DOCUMENTS

CN 203937950 U 11/2014
DE 9108036 U1 8/1991

(Continued)

OTHER PUBLICATIONS

PCT Search Report Corresponding to Application No. PCT/US2022/026726 on Jan. 25, 2023.

(Continued)

*Primary Examiner* — Luan K Bui
(74) *Attorney, Agent, or Firm* — Dority & Manning, P.A.

(57) ABSTRACT

The present disclosure relates to dispensing containers for storing and dispensing folded sheet material. The dispensing container of the present disclosure can be constructed so as to be free of any polymer films. The dispensing container includes a unique dispensing opening that is integral with one wall of the container. The dispensing opening includes a pair of opposing parabolic flaps and a pair of opposing resilient edges that form the perimeter of an opening. The parabolic flaps have spring-like properties in relation to the resilient edges that apply forces to a sheet material being dispensed. In this manner, the different elements combine together to maintain a sheet material in an upright position without falling back into the container.

24 Claims, 8 Drawing Sheets

(58) Field of Classification Search
USPC ..... 206/233, 494; 221/45–48, 63, 303, 307, 221/309, 310
See application file for complete search history.

(56) References Cited

U.S. PATENT DOCUMENTS

| | | | | |
|---|---|---|---|---|
| 4,678,099 | A * | 7/1987 | Matsui | A47K 10/424 221/48 |
| 5,219,421 | A | 6/1993 | Tipping | |
| 5,316,177 | A | 5/1994 | Boldt | |
| 6,419,114 | B1 * | 7/2002 | Lenz | B65D 83/0805 221/50 |
| 7,134,572 | B2 * | 11/2006 | Morin | B65D 83/0805 221/33 |
| 2003/0146231 | A1 | 8/2003 | Sarbo et al. | |
| 2003/0155263 | A1 * | 8/2003 | Morin | B65D 83/0805 206/494 |
| 2016/0318685 | A1 * | 11/2016 | Droege | B65D 77/0413 |
| 2018/0022534 | A1 | 1/2018 | McCormick | |

FOREIGN PATENT DOCUMENTS

| | | | |
|---|---|---|---|
| EP | 0930243 | A1 | 7/1999 |
| JP | 2005001720 | A | 1/2005 |
| KR | 20010071177 | A | 7/2001 |
| WO | WO2021150207 | A1 | 7/2021 |

OTHER PUBLICATIONS

Chinese Search Report Corresponding to Application No. 202280095214.4 on Mar. 25, 2026.

* cited by examiner

DISPENSER FOR SHEET MATERIALS

RELATED APPLICATIONS

The present application is the national stage entry of International Patent Application No. PCT/US2022/026726 having a filing date of Apr. 28, 2022, which is incorporated herein in its entirety by reference thereto.

BACKGROUND

Pop-up style dispensers have been used for some time to release individual folded sheet products such as facial tissues and the like. Such dispensers typically include a container and a stack, or "clip", of interfolded tissues disposed within the container. The tissues may be folded so that once the top tissue in the clip is withdrawn, subsequent sheets are individually presented above the top plane of the container for individual use.

The above dispensers typically include a dispensing window. The dispensing window comprises a dispensing slit or cutout portion that may be configured to hold tissues for pop-up type dispensing. For example, conventional pop-up style dispensers include a plastic film that covers the dispensing window. The plastic film includes the dispensing slit. Once the top tissue has been raised through the dispensing slit in the plastic film, subsequent tissues are held in an upright position by the plastic film for individual use. More particularly, once one tissue is removed from the dispenser, the following tissue is partially pulled out and is held in a substantially upright position by the slit in the plastic film.

Conventional dispensers for tissue products, such as facial tissues, industrial wipers, and the like, are made from a paperboard material to which the plastic film is adhered. Prior to use of the container, the dispensing window is typically covered with a perforated flap. In order to access the tissue product, the perforated flap is removed from the dispenser and discarded, thereby exposing the dispensing window and the underlying plastic film.

The above dispenser configuration has enjoyed tremendous success. The plastic film has been found well suited for applying a suitable amount of force to an individual tissue so that the tissue will remain in an upright position and not fall back into the interior of the dispenser.

Although plastic films have performed well in tissue dispensers, the plastic films create various problems and drawbacks. For instance, incorporating a plastic film into a carton made from paperboard significantly complicates the ability to recycle the paperboard material. The presence of the plastic film, for instance, can prevent the paperboard carton from entering paper recycling streams and from being able to easily place the used dispensing carton back into a repulping process. In addition, the flap that must be initially removed from the dispenser in order to expose the plastic dispensing window represents waste that is typically not recaptured in the recycling stream but, instead, is disposed separately from the used container.

In addition, previous attempts to replace slit plastic films with more environmentally friendly materials have not been entirely successful. For example, U.S. Pat. No. 5,316,177, which discloses a pop-up facial tissue carton with a paper window having an elongated opening with two or more slits emanating from its two ends, created a large degree of friction between the dispensed tissue sheet and the paper window. While the high degree of friction prevented fallbacks, it was noisy and caused tearing of the paper window.

German Utility model G9108036 also discloses a carton having a paper dispensing window. To reduce the degree of friction between the dispensed sheet and the paper dispensing window, the window is provided with an opening that extends all the way to the carton opening at two or more points. While such designs may reduce the amount of friction, they are susceptible to fallbacks and the window is easily deformed, bent, or torn.

In view of the above, a need currently exists for an improved dispenser opening configuration that can hold a tissue sheet in an upright position for facilitating pop-up dispensing while minimizing fallback of the tissues into the dispenser. A need also exists for a sustainable tissue dispenser that can enter a recycling stream, such as the paper recycling stream, after all the tissues have been dispensed. In addition, a need exists for a tissue dispenser that does not include a plastic film that covers a dispensing window.

SUMMARY

The present disclosure is generally directed to an improved dispenser for individual sheet materials, such as tissue products, which can fulfill one or more of the above needs. The tissue dispenser of the present disclosure, for instance, can be made exclusively from a paperboard material and, in one aspect, from a single piece blank. The dispenser can be formed without the use of a plastic film making the dispenser or container sustainable and well suited for entering the paper recycling stream and/or for being fed to a repulping process and converted back into new product. In this regard, the dispenser or container of the present disclosure defines a dispensing opening that can be formed exclusively from a wall of the container that is suitably configured to facilitate pop-up dispensing of tissue sheets while minimizing fallback.

For example, in one embodiment, the present disclosure is directed to a container for holding and dispensing a plurality of individual sheets. The container includes a carton having at least one carton wall and defining a hollow enclosure for receiving the plurality of sheets. A dispensing opening is disposed on the at least one carton wall. The dispensing opening has a perimeter sufficient to permit sheets to be dispensed therethrough. In accordance with the present disclosure, the dispensing opening is associated with a first parabolic flap having a first apex end and a second parabolic flap having a second apex end. The first apex end of the first parabolic flap is spaced from the second apex end of the second parabolic flap. The first and second apex ends form a portion of the perimeter of the dispensing opening. The first parabolic flap comprises two diverging slits that extend from the first apex end and, similarly, the second parabolic flap comprises two diverging slits that extend from the second apex end.

The dispensing opening is further associated with a first resilient edge opposing and spaced from a second resilient edge. The first resilient edge forms a portion of the perimeter of the dispensing opening between the first and second apex ends and the second resilient edge forms a portion of the perimeter of the dispensing opening between opposite sides of the first and second apex ends. The first and second resilient edges have a linear or curved shape that is non-convex with respect to the dispensing opening. In one aspect, the first and second resilient edges are more resilient to upward forces caused by sheets being dispensed through the dispensing opening than the first and second apex ends of the first and second parabolic flaps. In this manner, the sheets being dispensed from the carton travel through at least one of the slits defined by the parabolic flaps. The slits apply sufficient pressure to a sheet emerging from the dispensing opening for holding the sheet in a partially extended position while preventing the sheet from falling back into the carton. Further, the above pop-up feature is created and produced by the dispensing opening without any polymer film being located below the dispensing opening and attached to the carton. In addition, the carton can be made from a single piece of material, such as a single blank. Although the carton can be made from various different materials including a polymer material, in one embodiment, the carton is made from a paperboard, such as a coated paper. The paperboard, for instance, can have a basis weight of from about 40 gsm to about 80 gsm.

In one embodiment, the container can further include a first score line spaced from the first resilient edge and a second score line spaced from the second resilient edge. The first and second score lines can have a shape that makes the corresponding first and second resilient edges more resilient to upward forces. For example, the first and second score lines can have an angular shape including a vertex. The vertex can point towards the corresponding resilient edge. In one aspect, the first and second score lines form obtuse angles. The first score line can extend from one slit on the first parabolic flap to one of the slits on the second parabolic flap. Similarly, the second score line can extend from the opposite slit on the first parabolic flap to the opposite slit on the second parabolic flap.

As described above, the first resilient edge and the second resilient edge can have a linear or curved shape. In one embodiment, the first resilient edge and the second resilient edge both have a concave shape or can be in the shape of a wavy line with respect to the dispensing opening.

The dispensing opening can have a size and shape that is sufficient to receive the hand of a user for grasping sheet materials contained within the carton. In one embodiment, the dispensing opening has a length between the first and second resilient edges of from about 40 mm to about 65 mm. The dispensing opening can have a width between the first and second apex ends that is also from about 40 mm to about 65 mm. The carton made in accordance with the present disclosure can have any suitable shape. For instance, the carton can be rectangular or can have curved walls.

In one embodiment, the dispensing opening is created by removing a perforated dispensing flap that forms the first and second apex ends and the first and second resilient edges. In this regard, the apex ends and the resilient edges can be formed from the at least one carton wall and can be coplanar with a surface of the at least one carton wall.

The container of the present disclosure can be used to dispense all different types of sheets, including facial tissues, premoistened wipes, industrial wipes, paper towels, and the like.

Another embodiment of the present disclosure is directed to a carton having at least one carton wall and defining a hollow enclosure for receiving a plurality of sheets. A dispensing opening is disposed on the at least one carton wall. The dispensing opening has a perimeter sufficient to permit sheets to be dispensed therethrough. A first parabolic flap having a first apex end is spaced from a second parabolic flap having a second apex end. The first and second apex ends form a perimeter of the dispensing opening. Each of the parabolic flaps comprise two diverging slits that extend from the corresponding apex end. The carton further includes a first resilient edge opposing and spaced from a second resilient edge that both form a portion of the perimeter of the dispensing opening. The first resilient edge and the second resilient edge are positioned between first and second apex ends. In accordance with the present disclosure, the first and second resilient edges are more resilient to upward forces caused by sheets being dispensed through the dispensing opening than the first and second apex ends of the first and second parabolic flaps. In this manner, the first and second parabolic flaps act as springs that apply pressure to sheets being dispensed through the opening. In addition, the slits extending from the apex ends also apply pressure to a sheet emerging from the dispensing opening for holding the sheet in a partially extended position while preventing the sheet from falling back into the carton.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
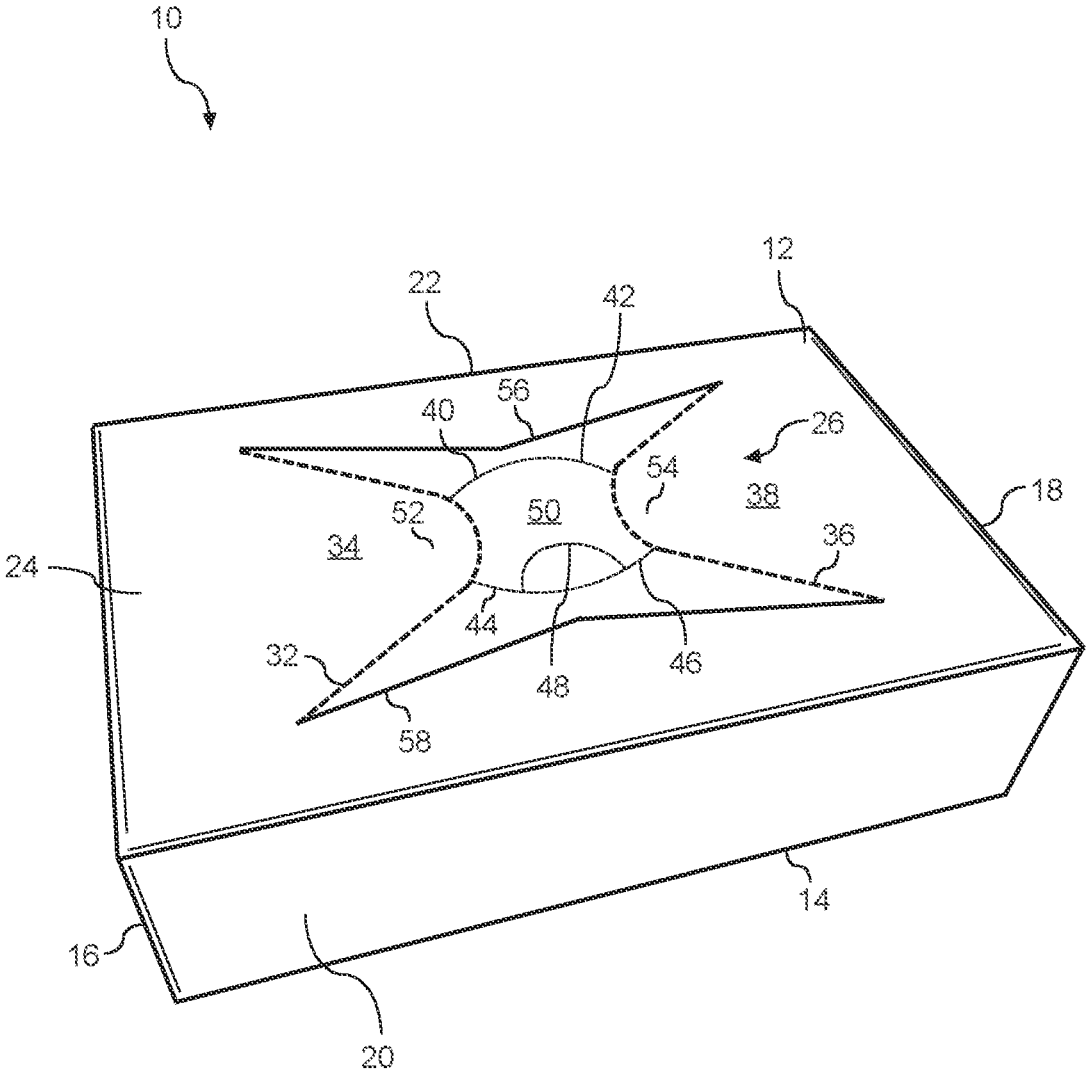
FIG. 1 is a perspective view of one embodiment of a container made in accordance with the present disclosure.

Repeat use of reference characters in the present specification and drawings is intended to represent the same or analogous features or elements of the present invention.

Definitions

As used herein, the term "dispensing opening" generally refers to an opening formed in one or more walls or panels of a dispensing container through which sheet materials are dispensed such as, for example, facial tissues.

As used herein the term "paper" or "paperboard" generally refers to a fibrous structure in sheet format. Paper useful in the present invention may be manufactured from a variety of paper-making fibers, such as, for example, natural fibers or synthetic fibers, or any other suitable fibers, and any combination thereof. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp.

As used herein the term "slit" generally refers to a cut where no material is removed. In certain embodiments a tissue carton of the present invention may be provided with a top wall having slits that are used to form or assist a dispensing opening.

As used herein the term "tissue" generally refers to any individual sheet product, such as facial tissue, dry or moistened wipes, for example household or industrial wipes, soap or fabric softening sheets, or the like. Normally, the basis weight of sheet products to be dispensed by the cartons of the present invention is less than about 80 grams per square meter (gsm), in some embodiments less than about 60 gsm, and in some embodiments, between about 10 to about 60 gsm.

DETAILED DESCRIPTION

It is to be understood by one of ordinary skill in the art that the present discussion is a description of exemplary embodiments only and is not intended as limiting the broader aspects of the present disclosure.

In general, the present disclosure is directed to a dispensing container for sheet materials, such as facial tissues, wipers, and the like. Of particular advantage, the container of the present disclosure can be sustainable and made entirely from biodegradable, compostable, and/or repulpable materials, such as a paper, a paperboard, or a recyclable polymer or other material. In one aspect, for instance, the container made according to the present disclosure, once emptied, can be collected and processed through a recycling stream, such as the paper recycling stream. In one embodiment, the container can be constructed without containing any polymer films. In fact, the empty container, in one embodiment, can be repulpable for making other cellulose fiber-based products.

In accordance with the present disclosure, the dispensing container includes a unique dispensing opening and associated slits formed into one wall of the container that are designed to hold a sheet material, such as a facial tissue, in an upright position extending from the dispensing opening while preventing the sheet material from falling back into the interior enclosure of the container. The dispensing opening, for instance, includes a pair of opposing spring-like flaps in combination with a pair of resilient edges positioned between the flaps along the perimeter of the opening that serve to work in conjunction to produce a pop-up style dispenser having an overall simple and elegant design. In this manner, a dispensing opening is formed that is integral with a top wall of the container in a way so as to present and hold a sheet material in place while preventing fallback issues. In addition, the dispensing opening can be formed into the container without the use of any polymer films.

Figure 2:
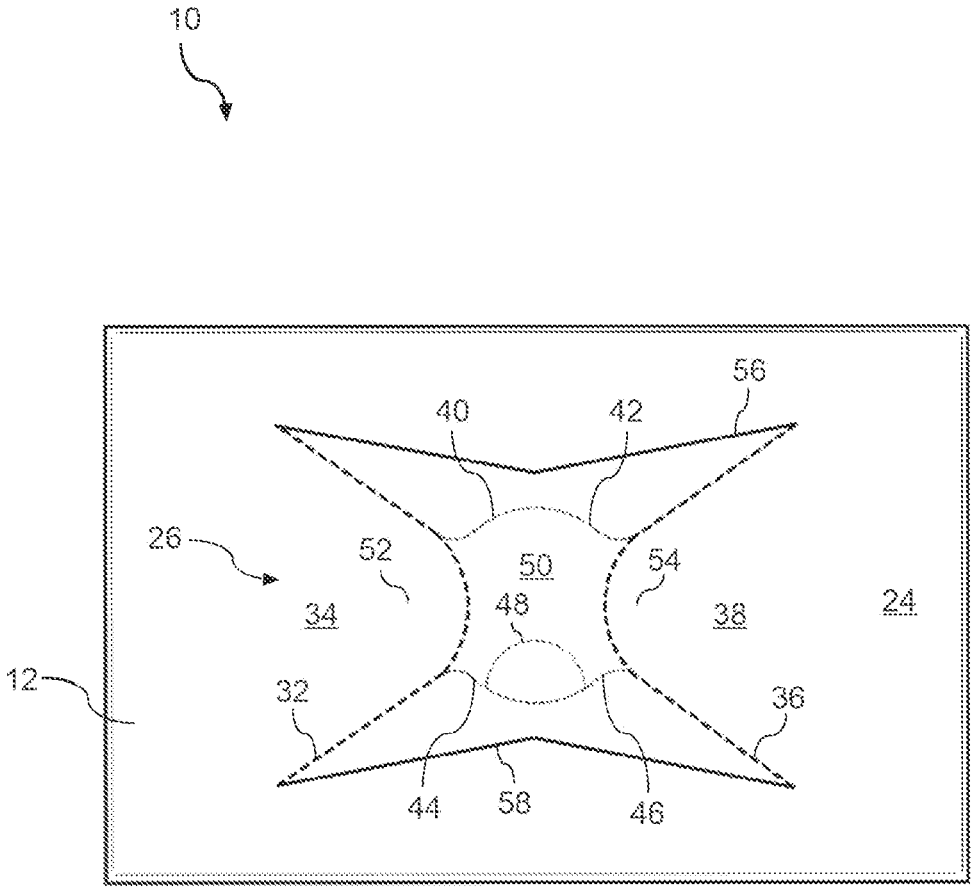
FIG. 2 is a top plan view of the container illustrated in FIG. 1.

Referring to FIGS. 1 and 2, for instance, a pop-up dispensing container or carton 10 according to one embodiment of the present disclosure is shown for purposes of illustration. Generally, a clip of tissues is disposed within the container or carton. While the container of the present invention is particularly well suited for dispensing tissue sheets, such as folded facial tissue sheets, the invention is not so limited. The invention may also be utilized to dispense other types of sheet products. Thus, the term tissue is not intended to be limited to facial tissues but is used herein to include any individual sheet product, such as dry or moistened wipes, for example household or industrial wipes, soap or fabric softening sheets, or the like.

The stack of tissues may be interfolded, prefolded interfolded, or non-interfolded. As used herein, the phrase "prefolded interfolded" or "interfolded" tissues means that the tissues are folded and interleaved with neighboring tissues immediately above and/or below in the clip of tissues. The tissues can be interleaved by any suitable means, including the use of an interfolder as employed in the papermaking arts. If an interfolder is used, consecutive tissues may be attached to each other at perforation lines. In such cases, the unperforated segments of the perforation lines should be sufficiently weak to permit the consecutive tissues to separate from each other upon removal from the carton. This can be controlled by the degree of perforation of the tissue sheet. Tissues that may be employed in a non-interfolded clip which are not interleaved with neighboring tissues are releasably attached to neighboring tissues so that upon dispensing one tissue, the next adjacent tissue is ready for dispensing. Particularly preferred folding patterns include interfolding patterns that provide somewhat less friction, which tend to avoid tearing of the tissue when extracted from the container.

Figure 4:
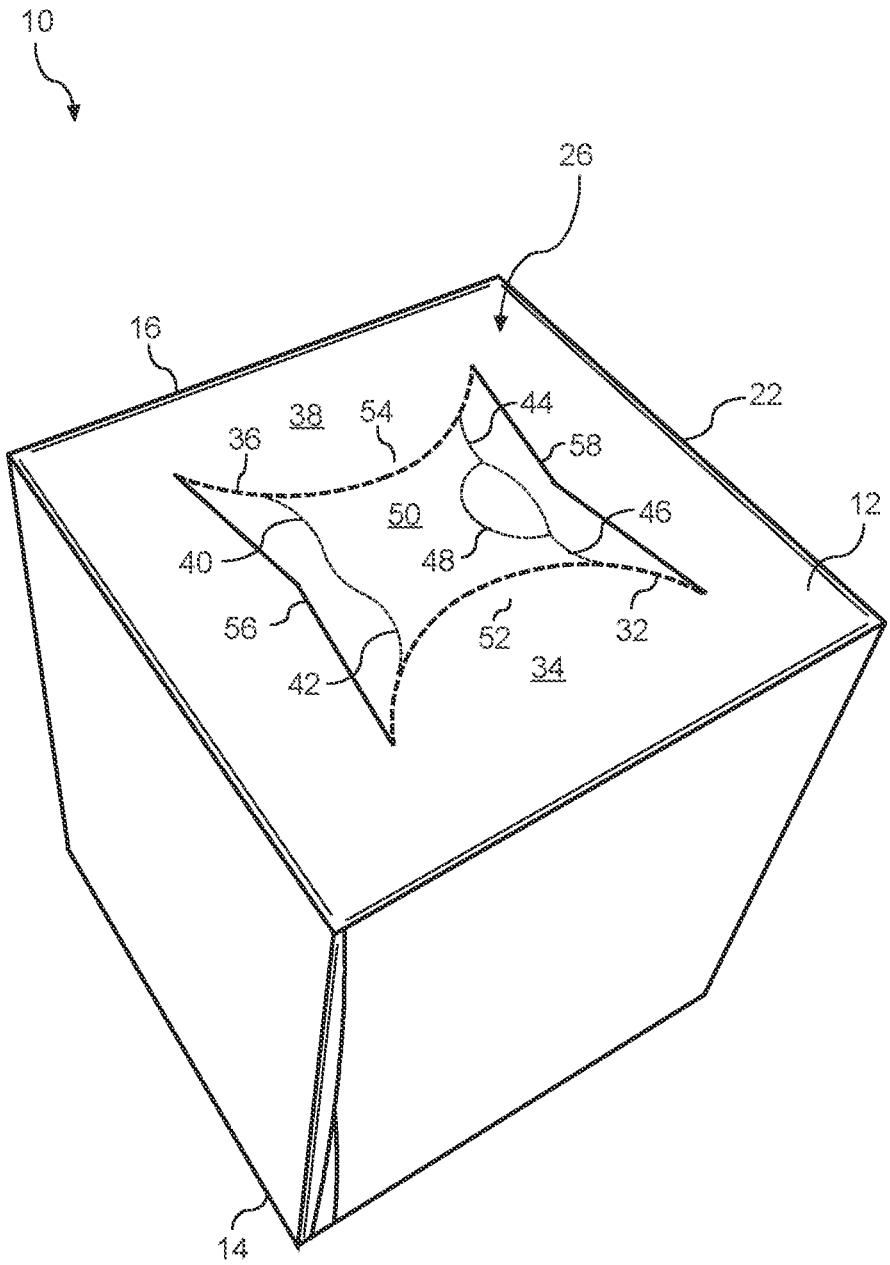
FIG. 4 is another embodiment of a container made in accordance with the present disclosure.
Figure 5:
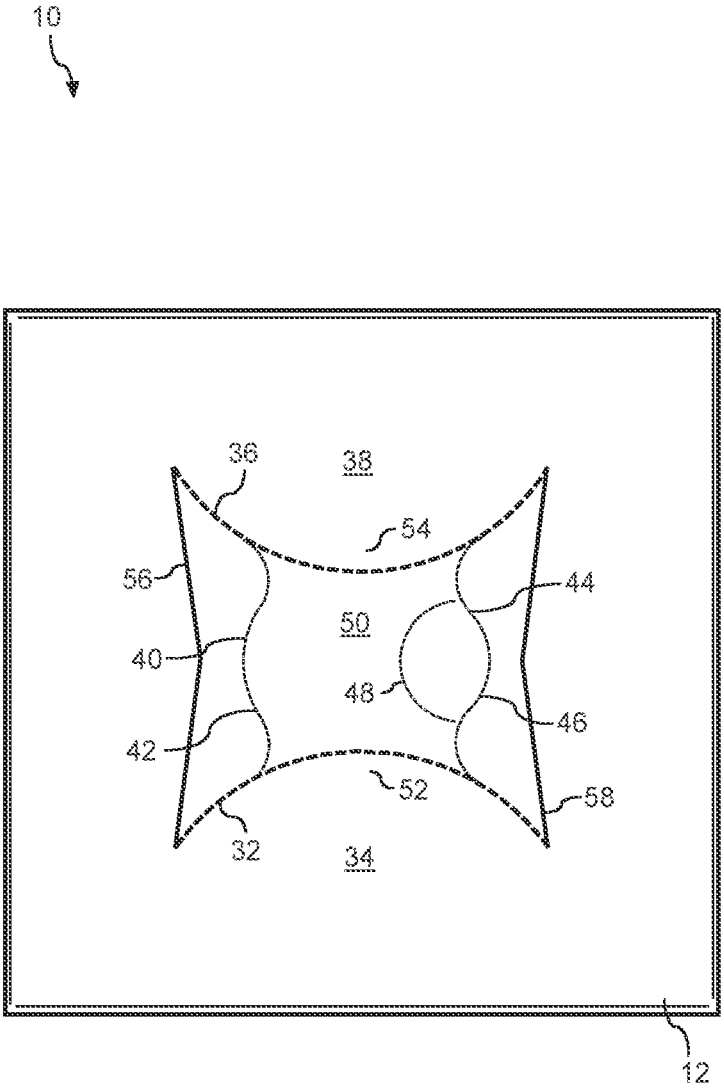
FIG. 5 is a top plan view of the container illustrated in FIG. 4.

As shown in FIGS. 1 and 2, the container 10 includes a top wall 12 opposite a bottom wall 14. The container 10 further includes a pair of opposing end walls 16 and 18 and a pair of opposing side walls 20 and 22. In the embodiment illustrated in FIG. 1, the dispensing container 10 has dimensions that allow for the sheet material to lay flat within the container. Thus, the dispensing container 10 as shown in FIGS. 1 and 2 generally has a rectangular shape. In other embodiments, however, the dispensing container 10 can have a more square, elevated configuration that holds the sheet materials in an upside down "U" shape as shown in FIGS. 4 and 5. In particular, the stack of sheet materials can be folded and placed into the dispensing container for dispensing the sheet materials one at a time. The unique dispensing opening of the present disclosure can be used in all different types of dispensing containers and the embodiment illustrated in FIGS. 1 and 2 are provided for exemplary purposes only.

The dispensing container 10 can be constructed from any rigid material. For example, the dispensing container 10 can be made from any suitable paper, such as cardboard, carton stock, paperboard, or the like. Alternatively, the dispensing carton 10 can be made from a polymer material, particularly a recyclable polymer material. The polymer material can comprise a polypropylene, a polyethylene, a polystyrene, or any other suitable plastic. In one particular embodiment, the dispensing container 10 is made from a paper, such as paperboard, which is capable of entering the paper recycling stream and/or is capable of being repulped into new products. For example, in one embodiment, the dispensing container 10 is made from a fiber sheet containing pulp fibers. The pulp fibers can comprise softwood fibers, hardwood fibers, bast fibers, recycled fibers, any other suitable cellulosic fibers, and mixtures thereof. The paper can be coated on one side with a polymer and/or clay material in order to provide some moisture resistance. The paper can have a basis weight of greater than about 40 gsm, such as greater than about 50 gsm, such as greater than about 60 gsm, such as greater than about 70 gsm, such as greater than about 80 gsm, such as greater than about 90 gsm, such as greater than about 100 gsm. The basis weight of the paper is generally less than about 150 gsm, such as less than about 120 gsm, such as less than about 100 gsm. In one embodiment, the basis weight of the paper is from about 40 gsm to about 80 gsm.

Not shown in the figures, the material used to produce the dispensing container 10 can also be designed to receive printed matter, such as text, trademarks, designs, and the like. For example, paper substrates are well suited for receiving printed matter. The printed matter can be applied to the paper substrate using any suitable technique, including flexographic printing, inkjet printing, and the like. In one embodiment, printed matter can be applied to the paper substrate and the paper substrate can then be coated with a polymer coating. The polymer coating can be transparent and can be repulpable. For instance, the polymer coating can be made from a natural gum or any suitable polysaccharide-based coating material.

Figure 7:
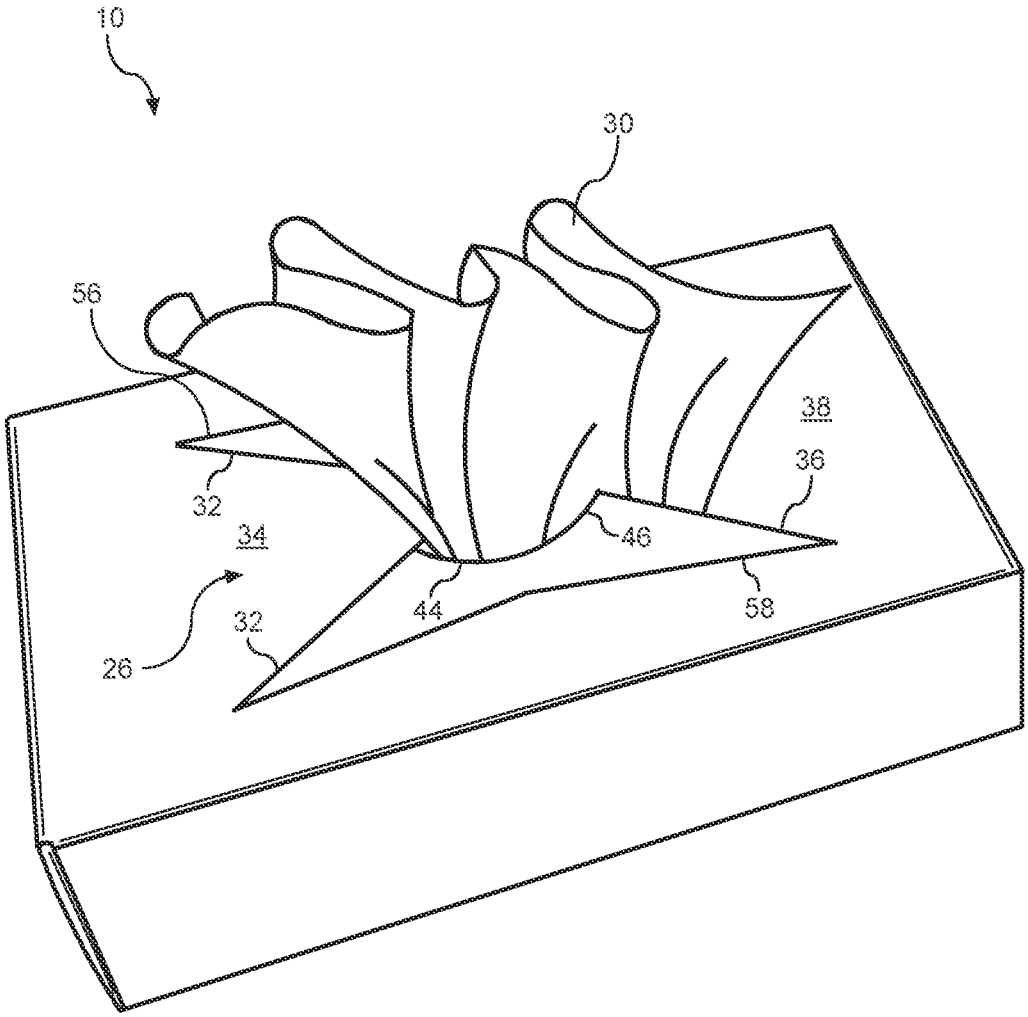
FIG. 7 illustrates a sheet material being dispensed from the container illustrated in FIG. 1.
Figure 8:
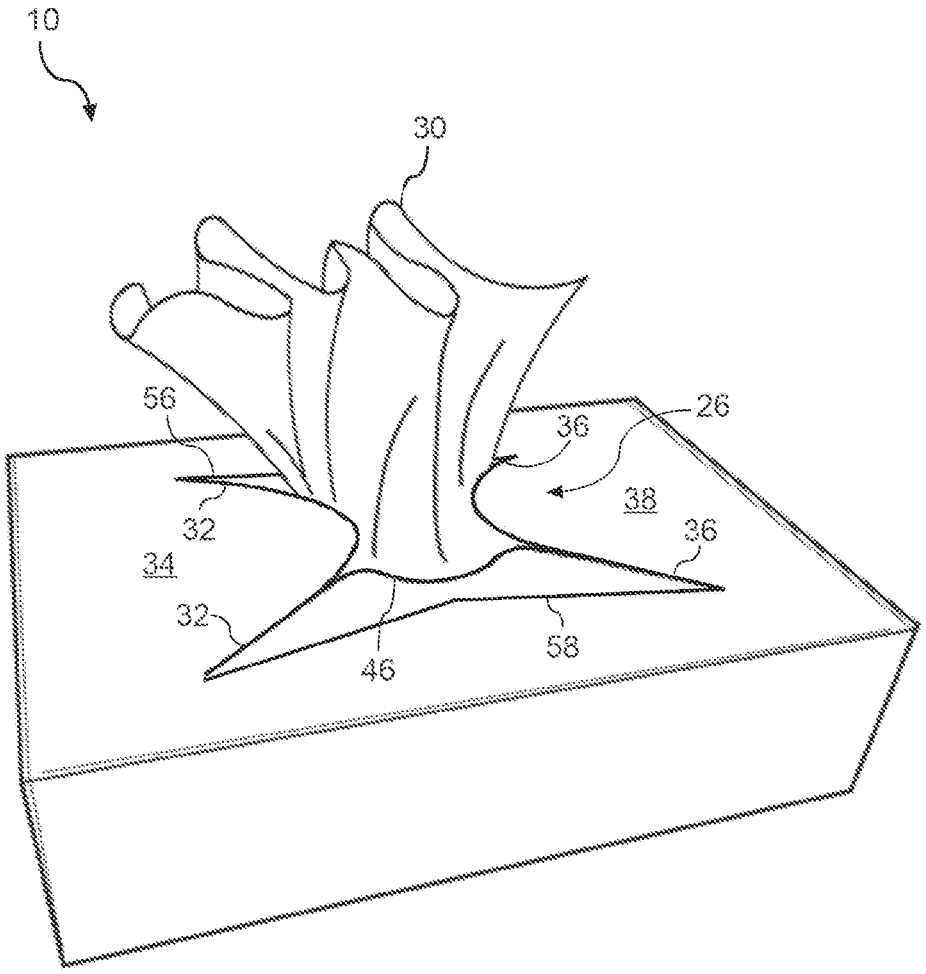
FIG. 8 is an alternative perspective view of a sheet material being dispensed from the container illustrated in FIG. 1.

In FIGS. 1 and 2, the container 10 is shown in an unopened condition. FIGS. 7 and 8, on the other hand, show the container 10 in an open configuration for dispensing individual sheet materials 30. As shown in FIGS. 1 and 2, the container 10 includes a dispensing surface 24 that defines a dispensing opening 26. As shown in the figures, the dispensing opening 26 can be formed into a wall of the container 10, such as the top wall 12. The dispensing opening, for instance, can be coplanar with the surface of the top wall 12 and can be integral with the top wall 12. In the embodiment illustrated in FIGS. 1 and 2, the dispensing opening 26 can initially be formed through a plurality of perforations. For example, in the embodiment illustrated in FIGS. 1 and 2, the dispensing opening 26 is defined by a first perforation 32 which forms a first parabolic flap 34 and a second perforation 36 that forms a second and opposing parabolic flap 38. The dispensing opening further includes a third perforation 40 that defines a first resilient edge 42 and a fourth perforation 44 that defines a second resilient edge 46.

Optionally, the dispensing opening 26 of the container 10 can further include a perforated tab 48 that intersects the fourth perforation 44. The perforations 32, 36, 40, 44, and 48 are all meant to be opened by a user by applying pressure to the top wall 12 of the container 10. In one embodiment, for instance, a user can first open the perforated tab 48. Once the perforated tab 48 is opened, a user can reach into the hollow enclosure defined by the container 10 and grab a tearaway flap 50 that is defined by the perforations 32, 36, 40, and 44. The tearaway flap 50 can be removed from the container 10 and discarded leaving an access opening sufficient for a user's hand to reach into the container 10.

When opening the container 10, in addition to removing the tearaway flap 50, the first perforation 32 and the second perforation 36 can also be torn opened by a user, producing the first parabolic flap 34 and the second parabolic flap 38. As shown in the figures, the first parabolic flap 34 includes a first apex end 52 and the second parabolic flap 38 includes a second apex end 54. As shown in FIGS. 1 and 2, the perimeter of the dispensing opening 26 is defined at one end by the first apex end 52 and at an opposite end by the second apex end 54. The remainder of the perimeter of the dispensing opening 26 is defined by the first resilient edge 42 positioned opposite the second resilient edge 46. The first resilient edge 42 is positioned between the first apex end 52 and the second apex end 54, while the second resilient edge 46 is also positioned between the first apex end 52 and the second apex end 54 on an opposite side. The dimensions of the dispensing opening 26 once the container 10 is opened can vary depending upon the particular application and various factors including the type of product being dispensed. In one embodiment, for instance, the width between the first and second apex ends 52 and 54 and the length between the first and second resilient edges 42 and 46 can independently be generally greater than about 40 mm, such as greater than about 44 mm, such as greater than about 48 mm, such as greater than about 52 mm, such as greater than about 56 mm, such as greater than about 60 mm, and can generally be less than about 100 mm, such as less than about 90 mm, such as less than about 80 mm, such as less than about 70 mm, such as less than about 65 mm, such as less than about 60 mm.

As shown particularly in FIGS. 7 and 8, once the dispensing opening 26 is opened, the first perforation 32 and the second perforation 36 become slits. For instance, perforation 32 forms two diverging slits 32 that extend from the first apex end 52. Similarly, perforation 36 forms two diverging slits 36 that extend from the second apex end 54. The slits 32 and 36 have various different functions. For instance, the slits allow the parabolic flaps 34 and 38 to more freely move in an up and down manner as sheet materials are being dispensed. The parabolic flaps 34 and 38, for instance, have spring-like characteristics during the dispensing of sheet materials 30. In addition, as shown in FIGS. 7 and 8, the sheet material 30 travels through the slits 32 and 36 during dispensing. In this manner, the slits 32 and 36 apply pressure to the sheet material 30 for preventing the sheet material from falling back into the container 10 after a leading sheet material is dispensed.

While the parabolic flaps 34 and 38 can pivot in an up and down manner during dispensing of the sheet materials, the container 10 in one embodiment is configured such that the resilient edges 42 and 46 remain more stationary during dispensing of the sheet materials. For instance, the resilient edges 42 and 46 can be designed to be more resilient to upward forces caused by sheets being dispensed through the dispensing opening 26 than the first and second apex ends 52 and 54 of the first and second parabolic flaps 34 and 38. The resiliency of the first and second resilient edges 42 and 46 can be maintained or increased based upon various design factors. For instance, the resiliency of the resilient edges 42 and 46 can depend upon the shape of the edges, the dimensions of the dispensing opening 26 and the shape and design of the parabolic flaps 34 and 38. Optionally, various features can also be built into the container 10 for further increasing the resiliency of the resilient edges 42 and 46. For example, in one embodiment, as shown in FIGS. 1, 2, 7 and 8, the container 10 can further define a first score line 56 opposite a second score line 58. As shown in FIG. 1, for example, the first score line 56 can be spaced from the first resilient edge 42 while the second score line 58 can be spaced from the second resilient edge 46. The score lines 56 and 58 have a shape that makes the corresponding first and second resilient edges 42 and 46 more resilient to upward forces. In one embodiment, for instance, the score lines 56 and 58 can have an angular shape and a vertex such that the vertex points towards the corresponding resilient edge 42 or 46 as shown in FIG. 1. In the particular configuration illustrated in FIG. 1, for instance, the score lines 56 and 58 each extend from the first perforation or slit 32 to the second perforation or slit 36. The first and second score lines 56 and 58 form obtuse angles. The score lines 56 and 58, for instance, can have angular shapes of greater than about 120°, such as greater than about 140°, such as greater than about 150°, such as greater than about 160°, and generally less than about 178°.

The resiliency of the resilient edges 42 and 46 to upward forces can also depend upon the shape of the edges. For example, in FIGS. 1 and 2, the first and second resilient edges have a concave shape with respect to the dispensing opening 26. Alternatively, the resilient edges 42 and 46 can be linear or can have any other suitable shape. In general, the resilient edges 42 and 46 are non-convex in shape. In one aspect, the resilient edges 42 and 46 can have a more complex shape including multiple curvatures or a combination of curvatures and linear elements.

In one embodiment, the container 10 is designed to dispense sheet materials one at a time. A stack of sheet materials can be contained within the hollow enclosure of the container 10 in an interfolded state. Once the first sheet is dispensed from the container 10, the remaining sheets can be dispensed in a pop-up style. In particular, the dispensing opening 26 is particularly designed to dispense sheet materials in a pop-up style without having to incorporate conventionally used polymer films below the dispensing opening. In this manner, the container 10 can be made from a single type of material and thus is more amenable to recycling processes.

As described above, the parabolic flaps 34 and 38 in combination with the slits 32 and 36 and the resilient edges 42 and 46 exert sufficient pressure on an emerging sheet 30 from the dispensing opening 26 for holding the sheet in a partially extended position as shown in FIGS. 7 and 8 while preventing the sheet 30 from falling back into the carton or container 10. In one embodiment, the sheet materials 30 can be dispensed in a "back and forth" style. For instance, as shown in FIG. 7, the sheet material 30 is shown in an upright position engaged within the slit 36 such that the sheet is adjacent the resilient edge 46. As sheet 30 is dispensed, the adjacent or trailing sheet is then maintained in an upright position as shown in FIG. 8. The next sheet or adjacent sheet, however, is engaged within the slits 32 and 36 adjacent the resilient edge 42. Thus, the slits 32 and 36 on one side are used to hold a sheet material 30 in an upright position until that sheet material is dispensed and the next sheet material is then held by the slits 32 and 36 on the opposing side of the dispensing opening 26. This design has been found to be particularly effective when dispensing interfolded sheets.

Of particular advantage, in one embodiment, the container 10 as shown in FIGS. 1, 2, 7 and 8, can be formed from a single piece of material or blank. For example, referring to FIG. 3, a single piece blank 70 is illustrated. Like reference numerals have been used to indicate similar characteristics and features in relation to the embodiment shown in FIGS. 1 and 2. In this regard, the blank 70 includes a top wall 12 that defines a dispensing opening 26 made in accordance with the present disclosure. In particular, the top wall 12 has been perforated by perforations 32, 36, 40, 44, and 48 to form the dispensing opening 26. In addition, the top wall 12 has been scored with score lines 56 and 58.

Figure 3:
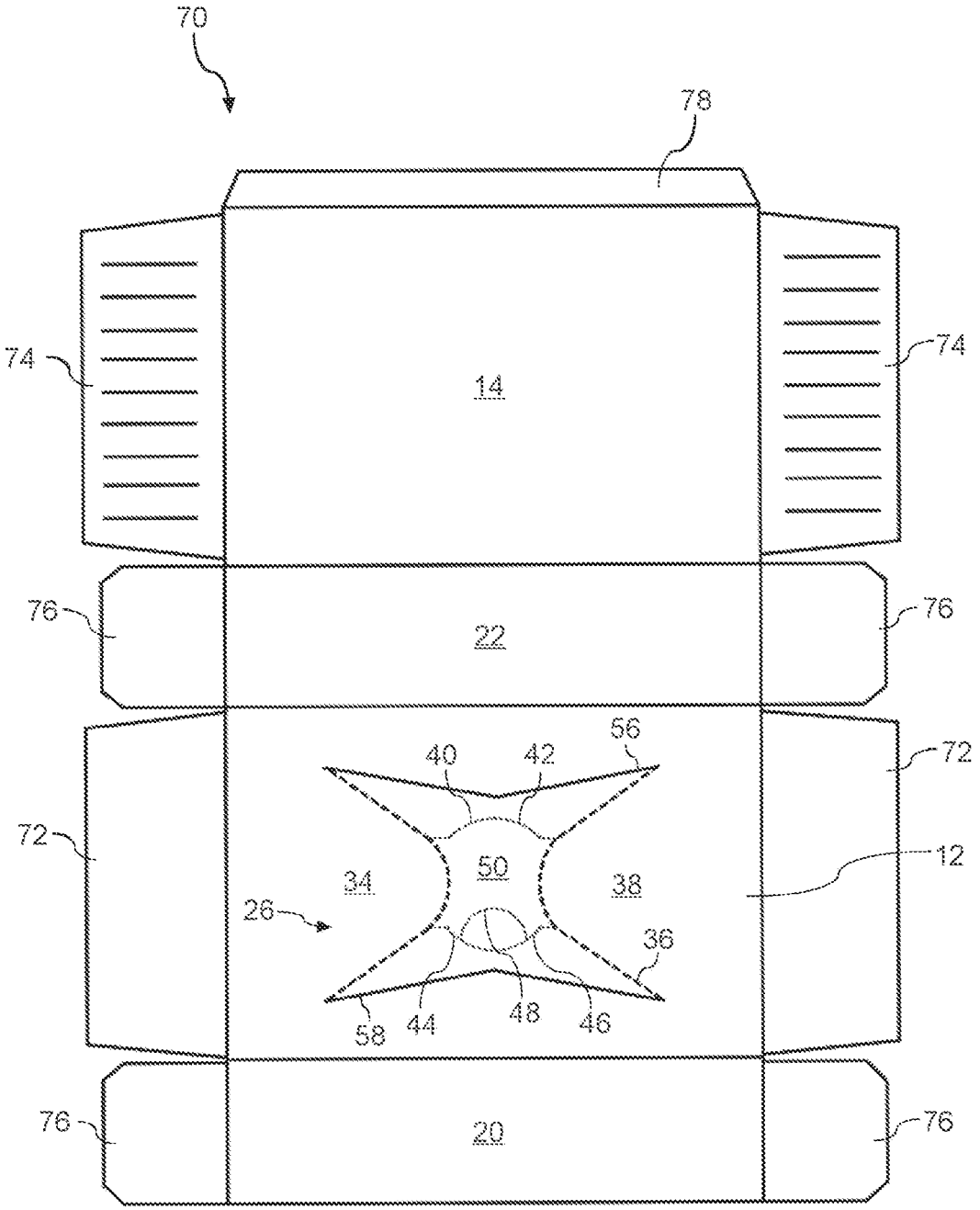
FIG. 3 is one embodiment of a blank that may be used to produce the container illustrated in FIG. 1.

As shown in FIG. 3, the blank 70 further includes a bottom wall 14, a first side wall 20 and a second side wall 22. The blank 70 further includes tabs 72 and tabs 74. The tabs 72 and the tabs 74 combine together on each side of the blank when the blank is formed into a container 10 as shown in FIG. 1. More particularly, the tabs 72 and 74 are attached together to form a first end wall 16 and a second end wall 18 as shown in FIG. 1. The blank 70 can also include side tabs 76 that can also attach together during assembly to further form and reinforce the end walls 16 and 18. Further, the blank 70 can include an end tab 78 that is used to connect the bottom wall 14 to the side wall 20.

The blank 70 can be made from any suitable material. In one aspect, the blank 70 can be made from a paper, such as a paperboard. The paperboard can comprise a coated paper having a basis weight of from about 40 gsm to about 80 gsm. For instance, the paperboard can be coated with a polymer coating. The polymer coating can increase moisture resistance, increase strength, and be receptive to printed matter and/or protect printed matter. In one aspect, the polymer coating can contain a film-forming polymer in combination with clay particles to produce a clay coating. The clay coating can be applied to the different walls of the container prior to forming the perforations, such as perforations 32, 36, 40, 44, and 48. Forming the perforations through a clay coating can help prevent tearing when the perforated portions are opened and can also prevent the propagation of tears or cuts.

In forming the blank 70, the paperboard or other material can be cut to a desired shape and coated. Various score lines can then be formed into the blank in order to facilitate folding of the walls and tabs. Score lines 56 and 58 can also be formed into the top wall 12.

In producing the product as shown in FIG. 1, a stack of sheet materials can be loaded into the blank 50 when in a partially assembled state or, alternatively, the blank 50 can be formed into a container around a stack of sheet materials. The sheet material can be in the form of individual sheets that are interfolded together to facilitate pop-up dispensing. The sheet material contained within the dispenser product of the present disclosure can vary. In one particular application, for instance, the product of the present disclosure can be configured to dispense facial tissues. In alternative embodiments, however, the dispensing container 10 can be configured to dispense other dry wipers, wet wipes, napkins, paper towels, or the like. In one embodiment, the dispensing container 10 is configured to dispense individual sheet materials formed from cellulosic fibers that have a bulk of greater than about 3 cc/g to about 20 cc/g and have a basis weight of from about 10 gsm to about 120 gsm, such as from about 20 gsm to about 60 gsm.

Figure 6:
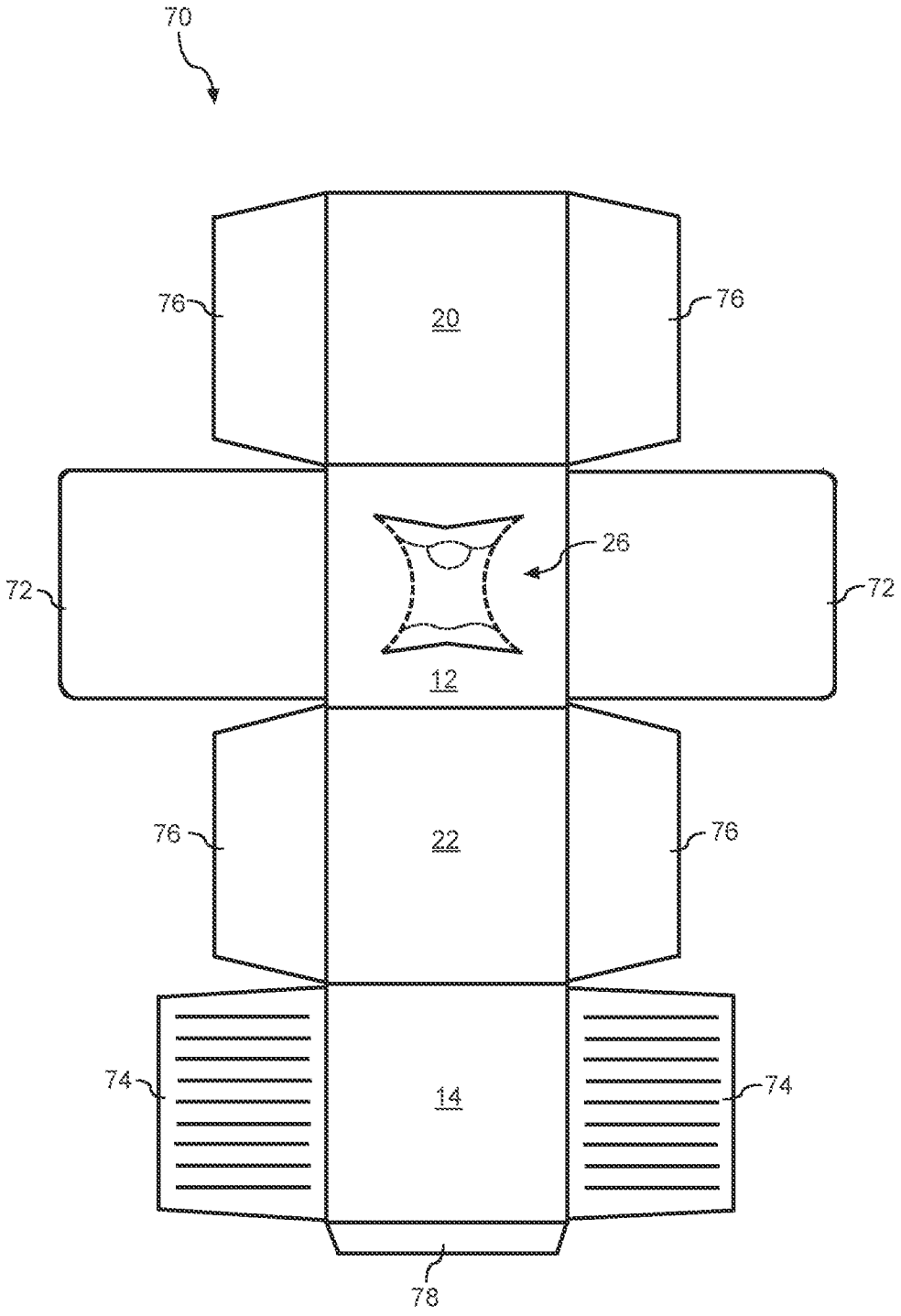
FIG. 6 is one embodiment of a blank that may be used to produce the container illustrated in FIG. 4.

In the embodiment illustrated in FIGS. 1-3 and 7-8, the container 10 has a rectangular-like shape. In particular, the container 10 has a top wall 12 and a bottom wall 14 that generally match the length and width dimensions of a stack of interfolded sheets loaded into the container. In this manner, the sheets lay flat in the container as they are dispensed one at a time. An alternative embodiment of a container 10 made in accordance with the present disclosure is illustrated in FIGS. 4-6. In the embodiment illustrated in FIGS. 4-6, the container has a more cube-like shape. Container 10 illustrated in FIG. 4 is particularly well suited to receiving a folded stack of sheet materials in the form of a clip that are loaded into the hollow enclosure of the container. Like reference numerals in FIGS. 4-6 have been used in order to indicate similar elements and features with respect to the embodiment illustrated in FIGS. 1-3.

As shown in FIGS. 4 and 5, the container 10 is generally in the shape of a cube and includes a top wall 12, two side walls 20 and 22, two end walls 16 and 18, and a bottom wall 14. In accordance with the present disclosure, a dispensing opening 26 is formed into the top wall 12.

As shown, the dispensing opening 26 includes perforations 32, 36, 40, 44, and 48. The perforations form a first parabolic flap 24 having a first apex end 52 and a second parabolic flap 38 having a second apex end 54. Perforations 44 and 48 form a first resilient edge 42 spaced from a second resilient edge 46. In addition, the dispensing opening 26 can optionally include a perforated tab 48. The container 10 further includes a first score line 56 positioned adjacent the first resilient edge 42 and a second score line 58 positioned adjacent the second resilient edge 46.

In the embodiment illustrated in FIG. 4, the first and second resilient edges 42 and 46 are in the shape of a wavy line having multiple curvatures. In addition, the parabolic flaps 34 and 38 and the perforations 32 and 36 have a more rounded curvature in relation to the embodiment illustrated in FIG. 1. It should be understood that the dispensing opening illustrated in FIG. 4 can be used on the container illustrated in FIG. 1 and the dispensing opening associated with the container in FIG. 1 can be used on the container illustrated in FIG. 4. Both dispensing openings have been found effective in dispensing sheet materials in a pop-up style without having to include a polymer film window.

The container 10 illustrated in FIGS. 4 and 5 can be formed from a single piece blank as shown in FIG. 6. The blank 70 illustrated in FIG. 6 includes a top wall 12 defining a dispensing opening 26. The blank 70 further includes a bottom wall 14, a first side wall 20, and a second side wall 22. Tabs 72 and 74 are designed to attach together to form end walls, such as end walls 16 and 18 as shown in FIG. 4. The blank 70 can further include tabs 76 and end tabs 78 for attaching the walls together for forming a consolidated unit.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only and is not intended to limit the invention so further described in such appended claims.

What is claimed:

1. A container for holding and dispensing a plurality of individual sheets comprising:

a carton having at least one carton wall and defining a hollow enclosure for receiving a plurality of sheets;

a dispensing opening disposed on the at least one carton wall, the dispensing opening having a perimeter sufficient to permit sheets to be dispensed therethrough;

a first parabolic flap having a first apex end and a second parabolic flap having a second apex end, the first apex end being spaced from the second apex end, the first and second apex ends forming a portion of the perimeter of the dispensing opening, and wherein the first parabolic flap comprises two diverging slits that extend from the first apex end and the second parabolic flap comprises two diverging slits that extend from the second apex end;

a first resilient edge opposing and spaced from a second resilient edge, the first resilient edge forming a portion of the perimeter of the dispensing opening between the first and second apex ends and the second resilient edge forming a portion of the perimeter of the dispensing opening between opposite sides of the first and second apex ends, the first and second resilient edges defining a linear or curved shape that is non-convex with respect to the dispensing opening; and a first score line spaced from the first resilient edge and a second score line spaced from the second resilient edge and wherein the first and second score lines have a shape that makes the corresponding first and second resilient edges more resilient to upward forces.

2. A container as defined in claim 1, wherein the first and second resilient edges are more resilient to upward forces caused by sheets being dispensed through the dispensing opening than the first and second apex ends of the first and second parabolic flaps.

3. A container as defined in claim 1, wherein the first and second score lines have an angular shape and a vertex and wherein the vertex points toward the corresponding resilient edge.

4. A container as defined in claim 1, wherein the first and second score lines form obtuse angles.

5. A container as defined in claim 1, wherein the first score line extends from one slit on the first parabolic flap to one of the slits on the second parabolic flap and wherein the second score line extends from the opposite slit on the first parabolic flap to the opposite slit on the second parabolic flap.

6. A container as defined in claim 1, wherein the first resilient edge has a concave shape and the second resilient edge has a concave shape with respect to the dispensing opening.

7. A container as defined in claim 1, wherein the dispensing opening has a length between the first and second resilient edges and a width between the first and second apex ends and wherein the length of the dispensing opening is from about 40 mm to about 65 mm and wherein the width of the dispensing opening is from about 40 mm to about 65 mm.

8. A container as defined in claim 1, wherein sheets being dispensed from the carton travel through at least one of the slits defined by the parabolic flaps, the slits applying sufficient pressure to a sheet emerging from the dispensing opening for holding the sheet in a partially extended position while preventing the sheet from falling back into the carton.

9. A container as defined in claim 1, wherein there is no polymer film located below the dispensing opening and attached to the carton.

10. A container as defined in claim 1, wherein the carton is made from a single piece of material.

11. A container as defined in claim 1, wherein the carton comprises a paperboard.

12. A container as defined in claim 11, wherein the paperboard comprises a coated paper having a basis weight of from about 40 gsm to about 80 gsm.

13. A container as defined in claim 1, wherein the dispensing opening is created by removing a perforated dispensing flap that forms the first and second apex ends and the first and second resilient edges, and wherein the first and second apex ends and the first and second resilient edges are coplanar with a surface of the at least one carton wall.

14. A container as defined in claim 1, wherein the container is formed from a single piece blank comprising a paperboard.

15. A product for dispensing a plurality of individual sheets one at a time comprising:

a stack of individual sheets; and the container as defined in claim 1, the stack of individual sheets being positioned within the hollow enclosure.

16. A container for holding and dispensing a plurality of individual sheets comprising:

a carton having at least one carton wall and defining a hollow enclosure for receiving a plurality of sheets;

a dispensing opening disposed on the at least one carton wall, the dispensing opening having a perimeter sufficient to permit sheets to be dispensed therethrough;

a first parabolic flap having a first apex end and a second parabolic flap having a second apex end, the first apex end being spaced from the second apex end, the first and second apex ends forming a portion of the perimeter of the dispensing opening, and wherein the first parabolic flap comprises two diverging slits that extend from the first apex end and the second parabolic flap comprises two diverging slits that extend from the second apex end;

a first resilient edge opposing and spaced from a second resilient edge, the first resilient edge forming a portion of the perimeter of the dispensing opening between the first and second apex ends and the second resilient edge forming a portion of the perimeter of the dispensing opening between opposite sides of the first and second apex ends, the first and second resilient edges defining a linear or curved shape that is non-convex with respect to the dispensing opening; and wherein the first and second resilient edges are more resilient to upward forces caused by sheets being dispensed through the dispensing opening than the first and second apex ends of the first and second parabolic flaps.

17. A container as defined in claim 16, wherein sheets being dispensed from the carton travel through at least one of the slits defined by the parabolic flaps, the slits applying sufficient pressure to a sheet emerging from the dispensing opening for holding the sheet in a partially extended position while preventing the sheet from falling back into the carton.

18. A container as defined in claim 16, wherein there is no polymer film located below the dispensing opening and attached to the carton.

19. A container as defined in claim 16, wherein the container is formed from a single piece blank comprising a paperboard.

20. A container as defined in claim 16, further comprising a first score line spaced from the first resilient edge and a second score line spaced from the second resilient edge and wherein the first and second score lines have a shape that makes the corresponding first and second resilient edges more resilient to upward forces.

21. A container as defined in claim 20, wherein the first and second score lines have an angular shape and a vertex and wherein the vertex points toward the corresponding resilient edge.

22. A container as defined in claim 20, wherein the first and second score lines form obtuse angles.

23. A container as defined in claim 20, wherein the first score line extends from one slit on the first parabolic flap to one of the slits on the second parabolic flap and wherein the second score line extends from the opposite slit on the first parabolic flap to the opposite slit on a second parabolic flap.

24. A container as defined in claim 16, wherein the first resilient edge has a concave shape and the second resilient edge has a concave shape with respect to the dispensing opening.

* * * * *